US006904924B2

(12) United States Patent
Warner

(10) Patent No.: US 6,904,924 B2
(45) Date of Patent: Jun. 14, 2005

(54) TRIANGULAR FRAME TENT

(75) Inventor: Gery Warner, Surrey (CA)

(73) Assignee: Tentnology Ltd. (BM)

( * ) Notice: Subject to any disclaimer, the term of this patent is extended or adjusted under 35 U.S.C. 154(b) by 398 days.

(21) Appl. No.: 09/929,362

(22) Filed: Aug. 15, 2001

(65) Prior Publication Data

US 2003/0034061 A1 Feb. 20, 2003

(51) Int. Cl.[7] ..... E04H 15/48
(52) U.S. Cl. ..... 135/144
(58) Field of Search ..... 135/143, 144, 135/97, 121, 87, 123; 52/63, 64

(56) References Cited

U.S. PATENT DOCUMENTS 690,102 A * 12/1901 Dummer ..... 135/100
2,677,384 A * 5/1954 Luisada ..... 135/118
2,716,992 A * 9/1955 Campfield et al. ..... 135/118
3,810,481 A * 5/1974 Nohmura ..... 135/120.3
4,367,761 A * 1/1983 Winant ..... 135/87
5,226,440 A * 7/1993 Fuhrman ..... 135/159
5,259,077 A * 11/1993 Hager et al. ..... 135/142
5,632,292 A * 5/1997 Carter ..... 135/145
5,930,971 A * 8/1999 Etheridge ..... 135/122
6,000,175 A * 12/1999 Gale et al. ..... 135/122
6,173,726 B1 * 1/2001 Talmadge ..... 135/122

FOREIGN PATENT DOCUMENTS

CA 2229401 * 8/1999
JP 402066271 * 3/1990

OTHER PUBLICATIONS

Internet Publication www.tentnology.com: Marquee Tent, Tentnology Ltd., 1994, 1998, pp. 2, 4, 6, 7 and 13.*

* cited by examiner

*Primary Examiner*—Janet M. Wilkens
(74) *Attorney, Agent, or Firm*—Hall, Myers, Vande Sande & Pequignot

(57) ABSTRACT

A frame tent having a triangular-shaped perimeter frame, a flexible canopy attached to said perimeter frame, three corner posts to support the perimeter frame at corners thereof, three cables each having one end attached to an upper end of an associated one of said corner posts and a free end attached to a common junction element, and a flying pole supported at one end by said common junction element and connected at another end to an interior surface of said canopy.

6 Claims, 5 Drawing Sheets

TRIANGULAR FRAME TENT

BACKGROUND OF THE INVENTION

1. Field of the Invention

The present invention relates to a tent structure whose top is supported by a flying pole, which rests on a cable network. The cable network is attached to the corners of the frame structure and the only frame elements extending down to the ground are those at the corners. The shape of the tent as viewed from the top is triangular. A plurality of triangular frame tents or a plurality of triangular frame tents in combination with tents of other shapes can be very efficiently used to cover irregular areas.

2. Description of Related Art

Although it is possible to join a number of square tents to cover a large square or rectangular area, it is more difficult to use a number of square tents to cover curved areas, areas with a sharp bend, or irregularly shaped areas. Accordingly, it is an object of the invention to provide an improved tent structure that more effectively allows the coverage of irregular areas.

It is a further object of the invention to provide a tent structure that can be used with other shapes of similar tent structures to produce a wide variety of overall shapes.

It is a still further object of the invention to provide a tent structure that can be expanded modularly to cover large areas.

SUMMARY OF THE INVENTION

According to the invention there is provided a triangular frame tent having a triangular-shaped perimeter frame comprising three corner joints coupled to at least three rigid frame members. The perimeter frame is supported by three corner posts, which are coupled to the corners of the perimeter frame. In addition there are three cables each having one end connected to a corresponding corner joint and another end removably connectable to a common junction element. A flexible roof canopy is attached to the perimeter frame and is tensioned by a flying pole, which is couplable at one end to the common junction element and at another end to an interior surface of the roof canopy. The point of contact between the flying pole and the roof canopy forms the peak of the triangular frame tent.

By tensioning the roof canopy with a flying pole supported by a cable network the present invention provides a structure free of interior poles that extend to the ground, which allows for unimpeded movement under the tent.

Due to its size and simple construction, the triangular frame tent, or a plurality of triangular frame tents, can be quickly and easily erected by one person.

Advantageously, the triangular frame tent may be modularly expanded allowing a plurality of tents to be coupled to cover large areas.

The triangular shape of the present invention makes it possible, when a plurality of triangular frame tents are joined together or when one or more triangular frame tents are joined to tents of other shapes, to more effectively provide cover to irregularly shaped areas than could be previously done without triangular frame tents.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

Figure 1:
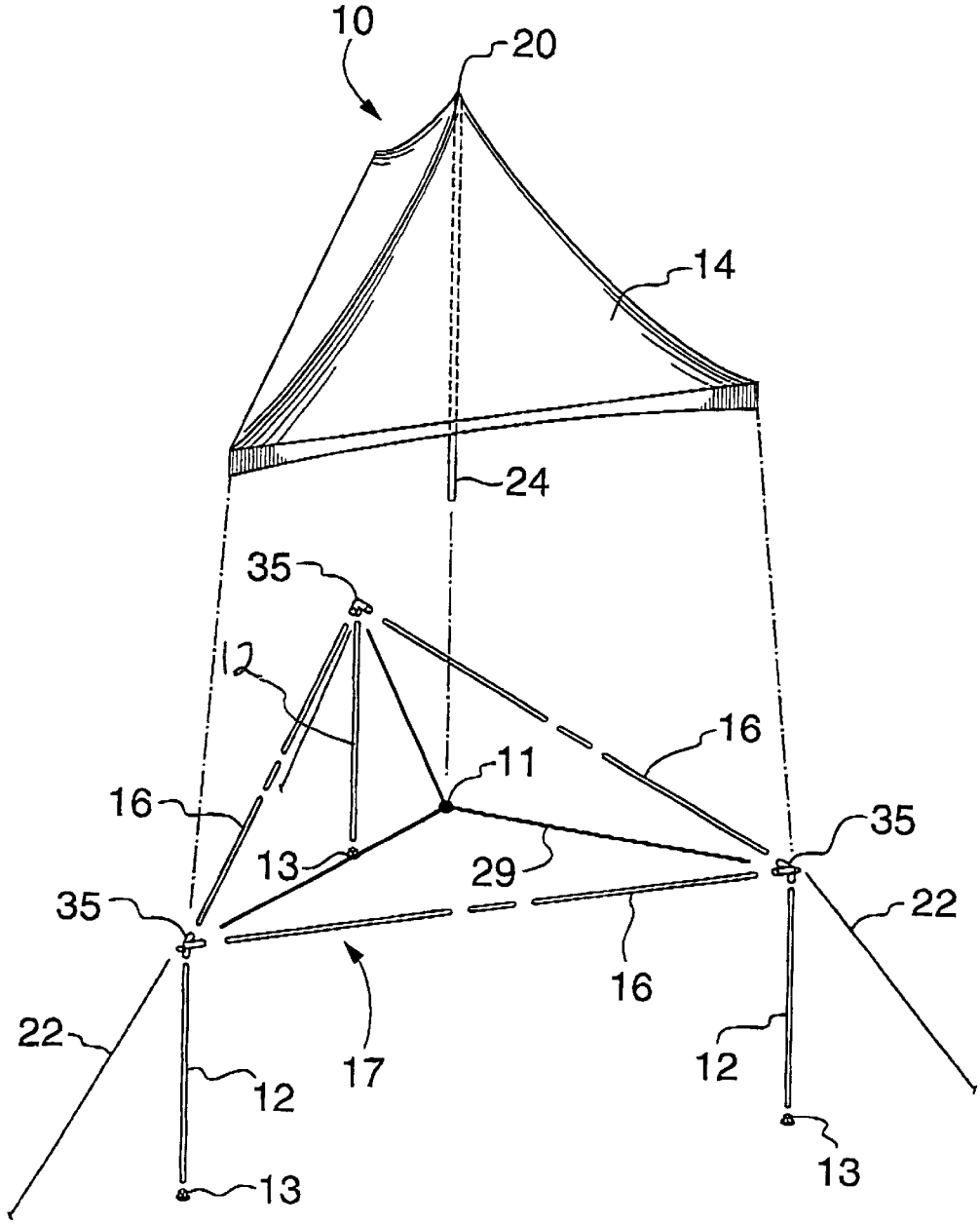
FIG. 1 is an exploded view of a triangular frame tent.

Referring to FIG. 1, the assembled triangular frame tent 10 consists of a perimeter frame 17 consisting of perimeter frame members 16 and corner joints 35. The perimeter frame 17 is supported from the ground by three corner posts 12 each resting on a base plate 13. The flexible canopy 14 is supported by a flying pole 24, which stands vertically, supported on junction 11 of cables 29. Peak 20 in the canopy 14 corresponds to the location where the flying pole 24 contacts the canopy 14. Guy wires 22 may be attached between each of the corner joints 35 and the ground to offset forces that tend to deform the perimeter frame 17 and to stabilize the tent against winds.

Figure 2:
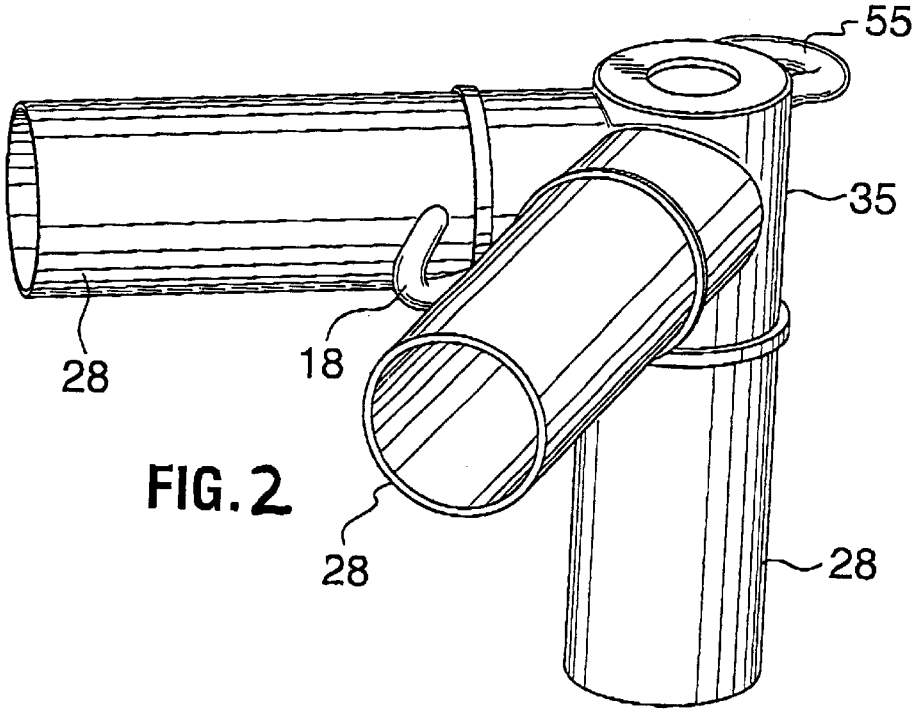
FIG. 2 is a perspective view of a corner joint.
Figure 3:
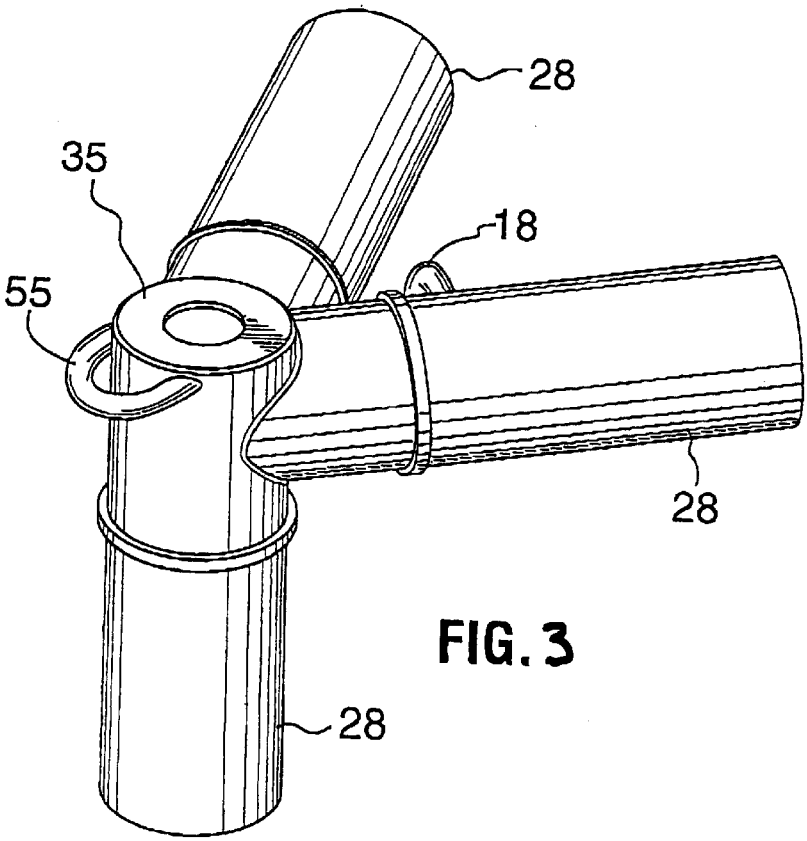
FIG. 3 is a perspective view of a corner joint.

Referring to FIGS. 2 and 3, there are shown perspective views of a corner joint 35 with frame connectors 28, an attachment point 18 for cables 29 (see FIG. 1) and attachment point 55 for guy lines 22 (see FIG. 1). The frame connectors 28 have a non-circular cross-section so as to prevent twisting of perimeter frame members 16 in response to tensioning of flexible canopy 14 (see FIG. 1).

The corner joints 35 may additionally include scuppers (not shown) to accept water from the roof canopy 14 and channel it down through the corner posts 12 (see FIG. 1). Corner joints 35 may further include additional frame connectors (not shown) operative to receive perimeter frame members of adjacent tent structures, such that two adjacent tents share common corner joints 35.

Referring to FIGS. 1, 2, and 3, assembly of the triangular frame tent 10 starts by assembling the perimeter frame 17. The first step is to insert the ends of the first perimeter frame member 16 into the frame connectors 28 of two corner joints 35.

Proceeding to step 2, the end (not shown) of the second perimeter frame member 16 is inserted into a frame connector 28.

Proceeding to step 3, the end (not shown) of the third perimeter frame member 16 is inserted into a frame connector 28 of the other of the corner joints 35 that is connected to the first perimeter frame member 16.

Proceeding to step 4, the remaining ends (not shown) of the second perimeter frame member 16 and the third perimeter frame member 16 are inserted into the frame connectors 28 of the third corner joint 35.

Once the perimeter frame 17 has been assembled, two corner posts 12 are connected to frame connectors 28 of respective corner joints 35 so as to raise one side of the perimeter frame 17. Three cables 29 are each connected at one end to attachment points 18 of corresponding corner joints 35, and at another end to a common junction element 11. A first end of the flying pole 24 is connected to the junction element 11 and a second end of the flying pole 24 is inserted into a canopy cup (not shown) at the center of the flexible canopy 14 making the entire structure tensioned. The third corner joint 35 of the perimeter frame 17 resting on the ground is then raised and the third corner post 12 is connected to the frame connector 28 of the third corner joint 35.

Figure 4:
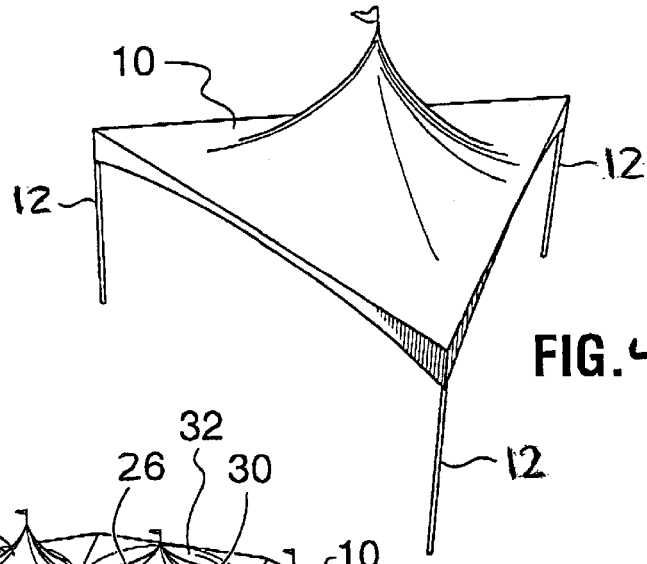
FIG. 4 is a perspective view of an assembled triangular frame tent.

Referring to FIG. 4, there is shown a perspective view of a fully assembled and tensioned triangular frame tent 10.

Figure 5:
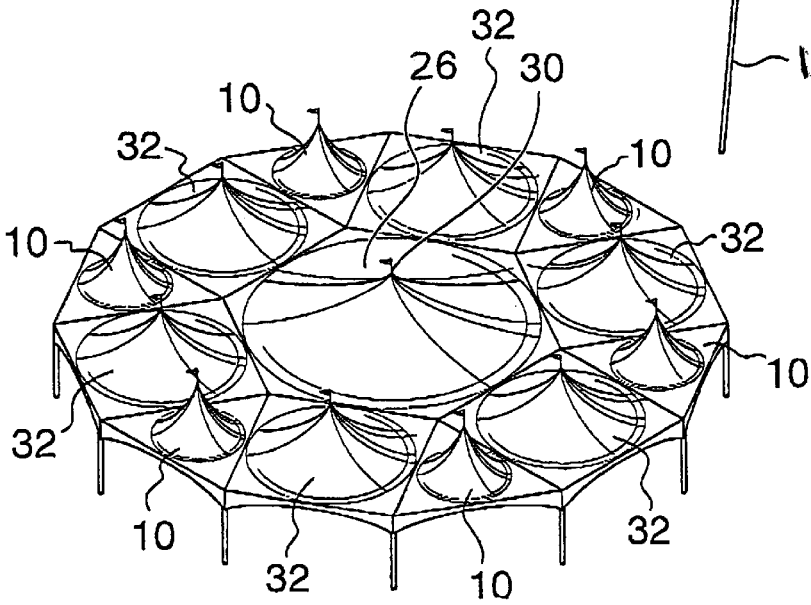
FIG. 5 is a perspective view showing how the triangular frame tent can be used with a hexagonal tent and square tents.

Referring to FIG. 5, there is shown a central hexagonal tent 26 tensioned by a flying pole compressed between a junction of six cables, each affixed to a corresponding corner joint, and the center of the canopy 30. Attached to each side of the hexagonal tent 26 is a similarly tensioned square tent 32. The uncovered areas between the square tents 32 are filled with triangular frame tents 10, thus producing a substantially circular-shaped combined tent structure. Adjacent tents in this configuration share perimeter frame members and there is only one perimeter frame member between adjacent tents. In addition, each pair of adjacent tents shares two corner joints located at the ends of said shared perimeter frame member. Said shared corner joints have additional frame connectors to connect to frame members of adjacent tents.

Figure 6:
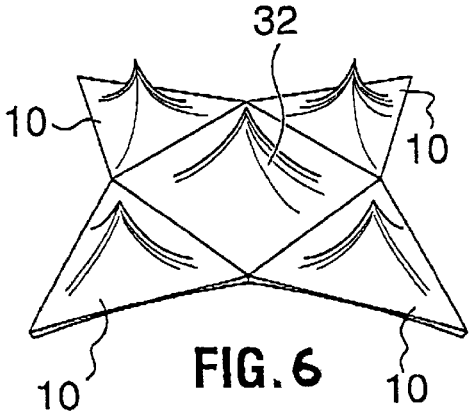
FIG. 6 is a perspective view showing how the triangular frame tent can be used with a square tent.

Referring to FIG. 6, another structure achieved by combining square tent 32 and triangular frame tents 10 is shown. In this instance, as in FIG. 5, adjacent tents share perimeter frame members and corner joints. The shared corner joints have additional frame connectors 28 (not shown) to connect to frame members of adjacent tents.

Figure 7:
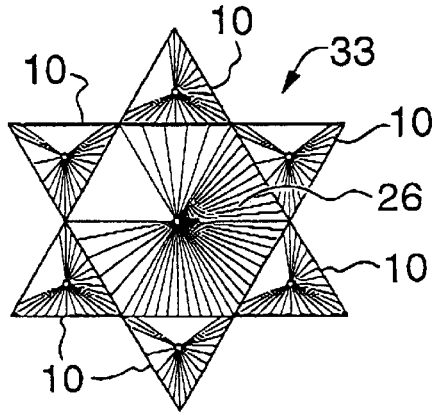
FIG. 7 is top view showing another alternative combination of how the triangular frame tent can be used with a central hexagonal tent to form a star shape.

Referring to FIG. 7, there is shown a combination of a central hexagonal tent 26 with several triangular frame tents 10 to achieve a star-shaped tent structure 33. In this instance, as in FIG. 5, adjacent tents share perimeter frame members and corner joints (not shown). The shared corner joints have additional frame connectors 28 (not shown) to connect to frame members of adjacent tents.

Figure 8:
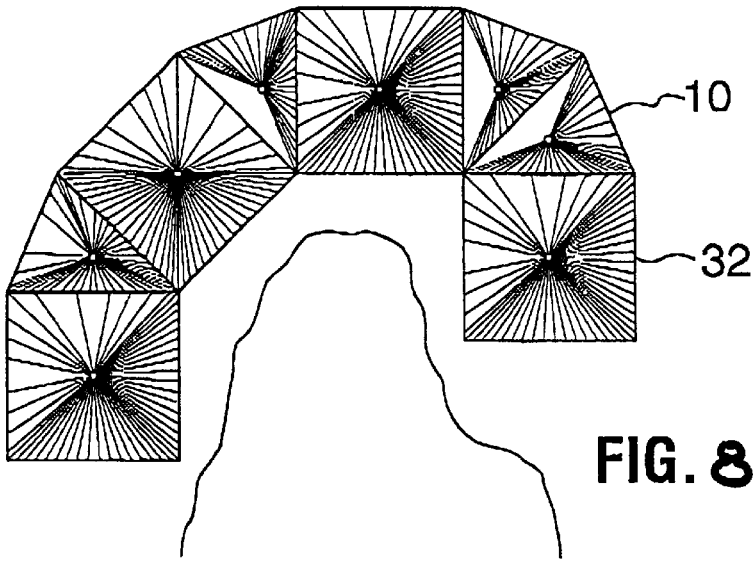
FIG. 8 is a top view of a combination of square and triangular frame tents used to follow an irregular shoreline.

Referring to FIG. 8, an alternative combination of square 32 and triangular frame tents 10 allows placement of the combination tent structure so that it follows a shoreline. It will be appreciated that any number of contours are made possible with the use of the triangular frame tent 10 in combination with tents of other shapes. In this instance, as in FIG. 5, adjacent tents share perimeter frame members and corner joints (not shown). The shared corner joints have additional frame connectors 28 (not shown) to connect to frame members of adjacent tents.

Figure 9:
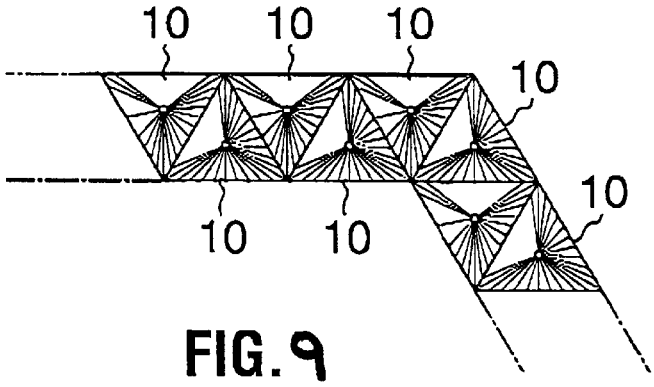
FIG. 9 is a top view of a plurality of triangular frame tents joined in linear sequence where a bend is introduced into the linear sequence.

Referring to FIG. 9, there is shown a combination of triangular frame tents 10 joined in linear sequence such that a bend is introduced into the linear sequence. This configuration may be used, for example, to cover a pathway with a bend or to follow a shoreline.

Figure 10:
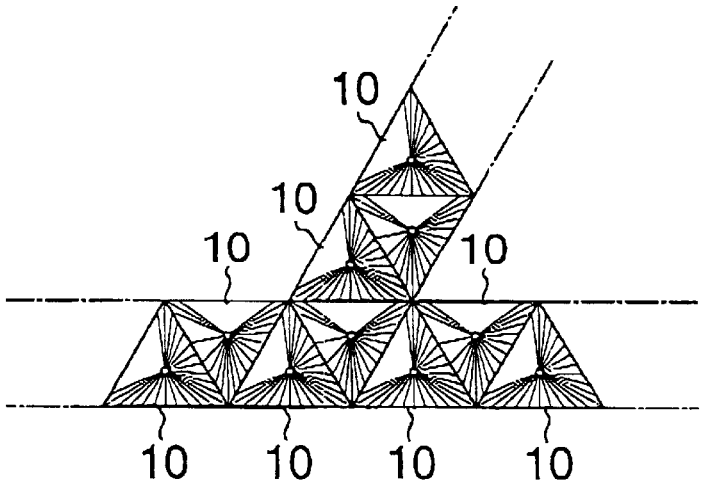
FIG. 10 is a top view of a plurality of triangular frame tents joined in linear sequence where the linear sequence branches in two.

Referring to FIG. 10, there is shown a combination of triangular frame tents 10 joined in linear sequence such that the linear sequence is branched. This configuration may be used, for example, to cover a branched pathway.

Figure 11:
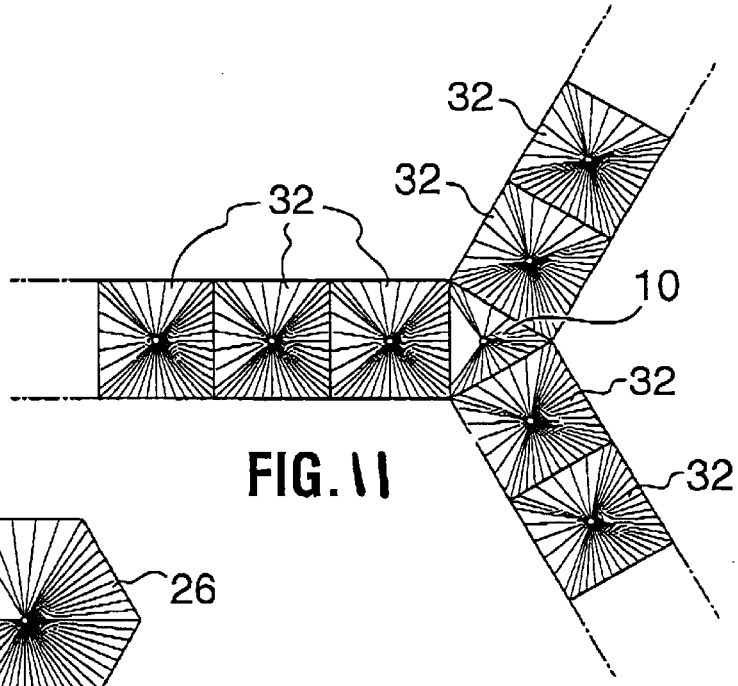
FIG. 11 is a top view of a plurality of square tents joined in linear sequence where a branch is introduced into the linear sequence by introducing a triangular frame tent.

Referring to FIG. 11, there is shown a combination of square tents 32, joined in linear sequence, and a triangular frame tent 10, such that said linear sequence is branched. This configuration may be used, for example, to cover a branched pathway.

Figure 12:
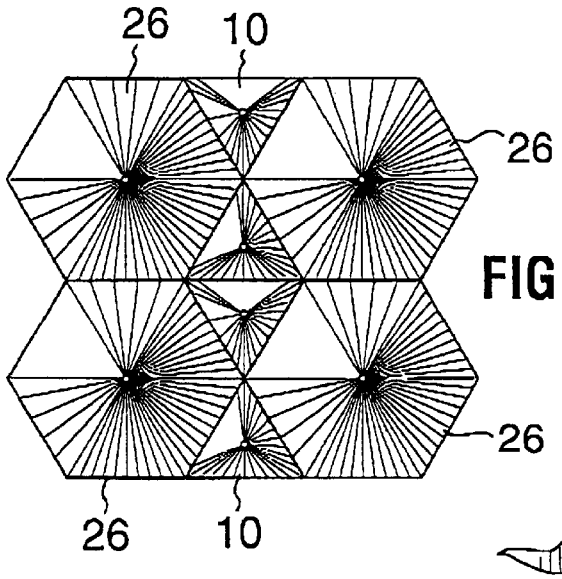
FIG. 12 is a top view of a combination of hexagonal tents and triangular frame tents wherein the areas between the hexagonal tents are covered by the triangular frame tents.

Referring to FIG. 12, a combination of triangular frame tents 10 and hexagonal tents 26 are shown whereby the spaces between the hexagonal tents 26 are covered by the triangular frame tents 10. This configuration may be used to cover large areas.

Figure 13:
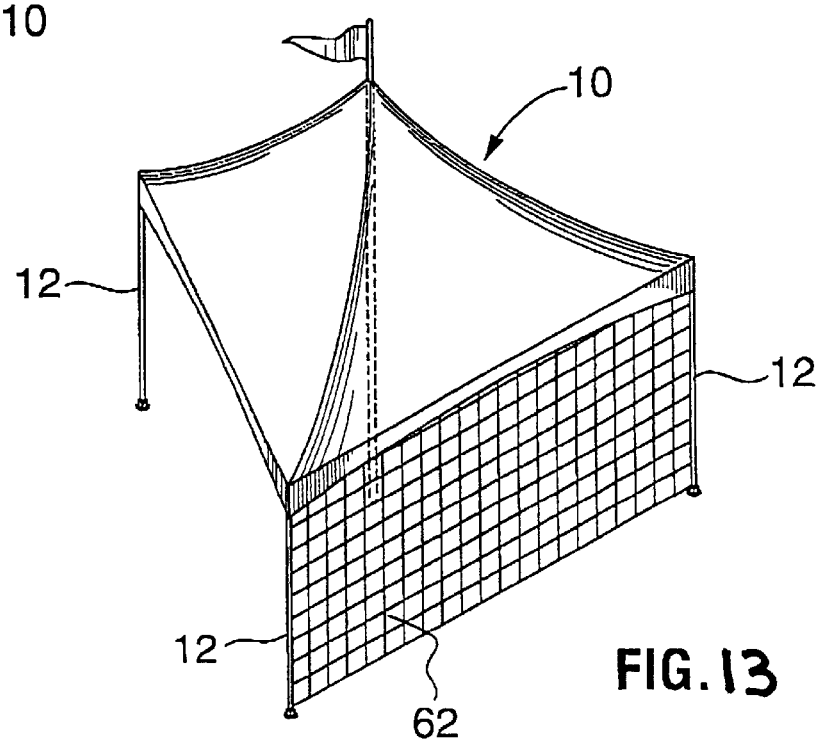
FIG. 13 is a perspective view of triangular frame tent with a wall membrane affixed.

Referring to FIG. 13, a flexible wall membrane 62 is attached along the length of the perimeter frame member 16 (see FIG. 1) and corner posts 12 so as to form a wall of the triangular frame tent.

While this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A triangular frame tent, comprising:

(a) a triangular perimeter frame;

(b) three corner posts each connected at one end to a respective corner of said perimeter frame and at another end resting on a support surface;

(c) three cables, each connected at one end to a common junction element, and each connected at a second end to a respective corner of said perimeter frame;

(d) a flexible canopy couplable to said perimeter frame; and (e) a pole attached at a first end to said common junction element and at a second end contacting, and thereby tensioning, said flexible canopy.

2. The triangular frame tent according to claim 1, wherein said triangular perimeter frame comprises three perimeter frame members, operatively coupled with three corner joints to form a closed triangle.

3. The triangular frame tent according to claim 2, wherein said three corner posts are each connected at a first end to a respective one of said corner joints and at a second end resting on a support surface.

4. The triangular frame tent according to claim 2, wherein each of said corner joints includes three frame connectors, two of said frame connectors being operative to engage a respective one of said perimeter frame members to form said perimeter frame and a third one of said frame connectors being operative to engage one of said corner posts.

5. The triangular frame tent according to claim 4, wherein each of said frame connectors has a non-circular cross-section and each of said perimeter frame members and said corner posts has a complementary cross-section such that said perimeter frame members and said corner posts cannot rotate along their axes when coupled with said frame connectors in response to tensioning of said flexible canopy.

6. A triangular frame tent, comprising:

(a) three elongated frame members;

(b) three corner posts, each connectable to ends of two of said three frame members to form a triangular perimeter frame;

(c) three cables connectable between respective ones of said three corner posts and a common junction element at another end;

(d) a flexible canopy couplable to said triangular perimeter frame; and (e) a pole attachable at a first end to said common junction element and at a second end contacting and tensioning said flexible canopy.

* * * * *